US005136808A

United States Patent [19]

Calderon

[11] Patent Number: 5,136,808

[45] Date of Patent: Aug. 11, 1992

[54] SLAGGING GASIFICATION APPARATUS

[76] Inventor: Albert Calderon, 1065 Melrose, Bowling Green, Ohio 43402

[21] Appl. No.: 521,545

[22] Filed: May 10, 1990

Related U.S. Application Data

[63] Continuation-in-part of Ser. No. 198,862, May 26, 1988, Pat. No. 4,927,430.

[51] Int. Cl.[5] ..... C10J 3/52; C10J 3/72

[52] U.S. Cl. ..... 48/62 R; 48/69; 48/76; 48/87; 48/DIG. 2

[58] Field of Search ..... 48/62 R, 69, 76, 77, 48/87, 111, DIG. 2, 65; 110/165 R, 171

[56] References Cited

U.S. PATENT DOCUMENTS

| | | | |
|---|---|---|---|
| 2,701,755 | 2/1955 | Strasser | 48/DIG. 2 |
| 4,129,422 | 12/1978 | Wood | 48/62 R |
| 4,247,367 | 1/1981 | Reilly | 201/16 |
| 4,268,275 | 5/1981 | Chittick | 48/111 |
| 4,312,637 | 1/1982 | Loftus | 48/77 |

FOREIGN PATENT DOCUMENTS

| | | | |
|---|---|---|---|
| 206490 | 11/1984 | Japan | 48/DIG. 2 |

*Primary Examiner*—Joye L. Woodard

*Attorney, Agent, or Firm*—MacMillan, Sobanski & Todd

[57] ABSTRACT

A gasifier for the gasification of a fuel material includes a chamber in which the material is converted into a gas and a molten slag. A quenching apparatus is provided for cooling and solidifying the molten slag. A nozzle extends between the chamber and the quenching apparatus. The nozzle includes an orifice having an inlet end for receiving the molten slag from the chamber and an outlet end for discharging the molten slag into the quenching apparatus. A recessed zone is provided between the outlet end of the orifice and the quenching apparatus. The recessed zone may be formed within the nozzle. An electric induction heating coil provides heat in the recessed zone to prevent the solidification of the slag at the outlet end of the orifice.

18 Claims, 2 Drawing Sheets

SLAGGING GASIFICATION APPARATUS

CROSS REFERENCE TO RELATED APPLICATION

This application is a continuation-in-part of application Ser. No. 07/198,862, filed May 26, 1988, now U.S. Pat. No. 4,927,430, issued May 22, 1990.

BACKGROUND OF THE INVENTION

The above referenced patent discloses a method and apparatus for the production and treatment of gases. In this same patent, a disclosure is made of a novel gasifier adapted for the continuous flow of slag from an orifice disposed to the bottom of the gasifier. FIGS. 3 and 5 accompanying the above referenced patent illustrate this slagging gasifier.

The present invention relates to gasifiers which gasify materials that contain ash, such as coal, trash, tires, etc. but in particular to gasifiers that gasify such materials and convert their residue to a molten slag, as for example the gasifiers described in U.S. Pat. Nos. 4,129,422 and 4,195,978. These referenced patents possess a slag removal, high thermal conductive metallic orifice which is centrally located in the bottom of the gasifier and through which orifice a liquid coolant circulates in order to prevent this metallic orifice from melting or distorting. The said orifice is adapted to have hot burner gases directed up through the bore of the orifice itself in order to have the gases retain the slag in molten condition on the hearth or bottom of the gasifier and to maintain a pool of slag above said orifice or said hearth. Periodically the slag is discharged through the liquid-cooled metallic orifice by stopping or reducing the burner gases output and by reducing the pressure in the quenching chamber located below the orifice by controlled venting to the atmosphere through a venting system so as to produce a differential pressure between the quenching chamber and the gasifier vessel (par. 1, col. 1 of U.S. Pat. No. 4,129,422 and par. 2 , col. 1 of 4,195,978), thereby providing an intermittent-flowing slagging gasifier. The disadvantages of such gasifiers are as follows:

1. That a pressure differential between the hearth of the gasifier and the quenching chamber must be provided to cause the slag to flow.

2. That a pool of slag is made to form at the hearth.

During the formation of such pool, the separation of the iron component in the slag from the silicates and aluminates takes place by virture of the iron being the heaviest. This iron tends to solidify at the orifice much quicker than if the iron component had not separated from the slag. In order to prevent such solidification, hot burner gases are directed up through the bore of the orifice in order to maintain the slag above the orifice in molten state and to cause the buildup of a molten pool of slag.

3. The system is much too complex structurally by virtue of having a metallic orifice in a critical area that possesses passages for a coolant in an environment that is difficult to maintain.

4. The referenced system cited is too costly.

Attempts have been made to provide a slagging gasifier with an orifice which is devoid of circulating coolant features and devoid of features for directing hot burner gases up through said orifice. However, since the outlet of the orifice is adjacent to the quenching chamber, excessive heat loss takes place causing the slag to form icicles (stalactites) which ultimately plug the orifice and interrupt the flow of the slag.

OBJECTIVES OF THE INVENTION

The present invention overcomes the disadvantages mentioned above and provides a superior and efficient gasifier adapted to produce vitrified slag from such materials like ash which is contained in coal, lignite, wastes, trash, tires and the like materials, this vitrified slag being inert as evidenced by Exhibit 1 attached herein.

Therefore, the main object of this invention is to provide a slagging gasifier which will produce inert vitrified slag from ash.

Another object of the present invention is to provide a slagging gasifier which is operated at pressure and is adpated to drain the slag therefrom without the depressurization of the gasifier.

Still another object of the present invention is to provide a slagging gasifier that is adapted for the flow of the slag therefrom in a molten state with features which prevent the gravitational separation of the constituents of the slag to result in an inert vitrified slag with said constituents being essentially uniformly blended in the slag, and in particular the prevention of the separation of the iron from the other constituents of the slag.

Further, another object of the instant invention is to prevent the formation of icicles or stalactites at the slag drainage orifice of the gasifier by insuring the conditions which are conductive for the free flow of molten slag from the gasifier.

Yet another object of the instant invention is to provide a quenching zone remotely below said slag draining orifice in order to solidify the molten slag.

It is still another object of the present invention to provide a hot radiant zone intermediate of said slag draining orifice and said quenching zone or make up for heat loss by said slag orifice in order to insure the prevention of the premature solidification of the slag prior to its entry into said quenching zone.

It is further another object of the present invention to provide a heating means surrounding said slag draining orifice to maintain the temperature of said slag draining orifice above the melting point of the slag to insure its flow in molten state through said slag draining orifice.

It is yet another object of the present invention to provide a heating means surrounding said radiant zone in order to maintain it at such temperature as to minimize the heat loss of the outlet end of said slag draining orifice.

It is therefore another object of the present invention to provide means for gasifying materials which contain ash to yield vitrified slag wherein the following is provided: means for charging materials containing ash; means for pyrolyzing said materials to form a char; means for feeding said char into a gasifier; means for gasifying said materials at such temperature as to yield a molten stag; a slag draining orifice equipped with heating means; means for maintaining the slag in a molten state to prevent the premature formation of solidified slag to avoid the closure of said slag draining orifice; a hot radiant zone beneath said slag draining orifice to separate said slag draining orifice from a subsequent quenching zone which quenches the slat after said slag is discharged from the bottom of said orifice; and means for removal of solidified slag from said means for gasifying said materials without the depressurization of said means for gasifying said materials.

These and other objects of the instant invention will become more apparent to those skilled in the art to which this invention pertains, and particularly from the following description and appended claims.

SUMMARY OF THE INVENTION

The instant invention integrates the following:

1. Means for handling a material that contains ash;
2. Means for pyrolyzing said material under pressure;
3. Gasifying means adapted to gasify under pressure the residue of said material subsequent to its pyrolysis, and capable of producing a molten slag;
4. Orifice means to direct said molten slag out of said gasifying means being equipped with heating means to insure that no solification of said molten slag takes place in said orifice means.
5. Hot radiant means disposed below said orifice to prevent the formation of stalactites at the exit end of said orifice means;
6. Means for quenching the molten slag after it leaves said hot radiant means to solidify it; and
7. Means for removing the solidified slag out of said quenching means while still maintaining pressure in said gasifying means.

For a more detailed description of the instant invention reference is now made to the accompanying drawings forming a part of this specification wherein like reference characters designate corresponding parts in the various views. It is to be understood herein that the embodiments shown herein are for the purpose of description and not limitation.

Before proceeding with the detailed description of the drawings, it is to be noted that for the sake of clarity reference will be made with numerals to represent the various components of the invention.

DETAILED DESCRIPTION OF DRAWINGS

Figures 1, 2, 3, 4:
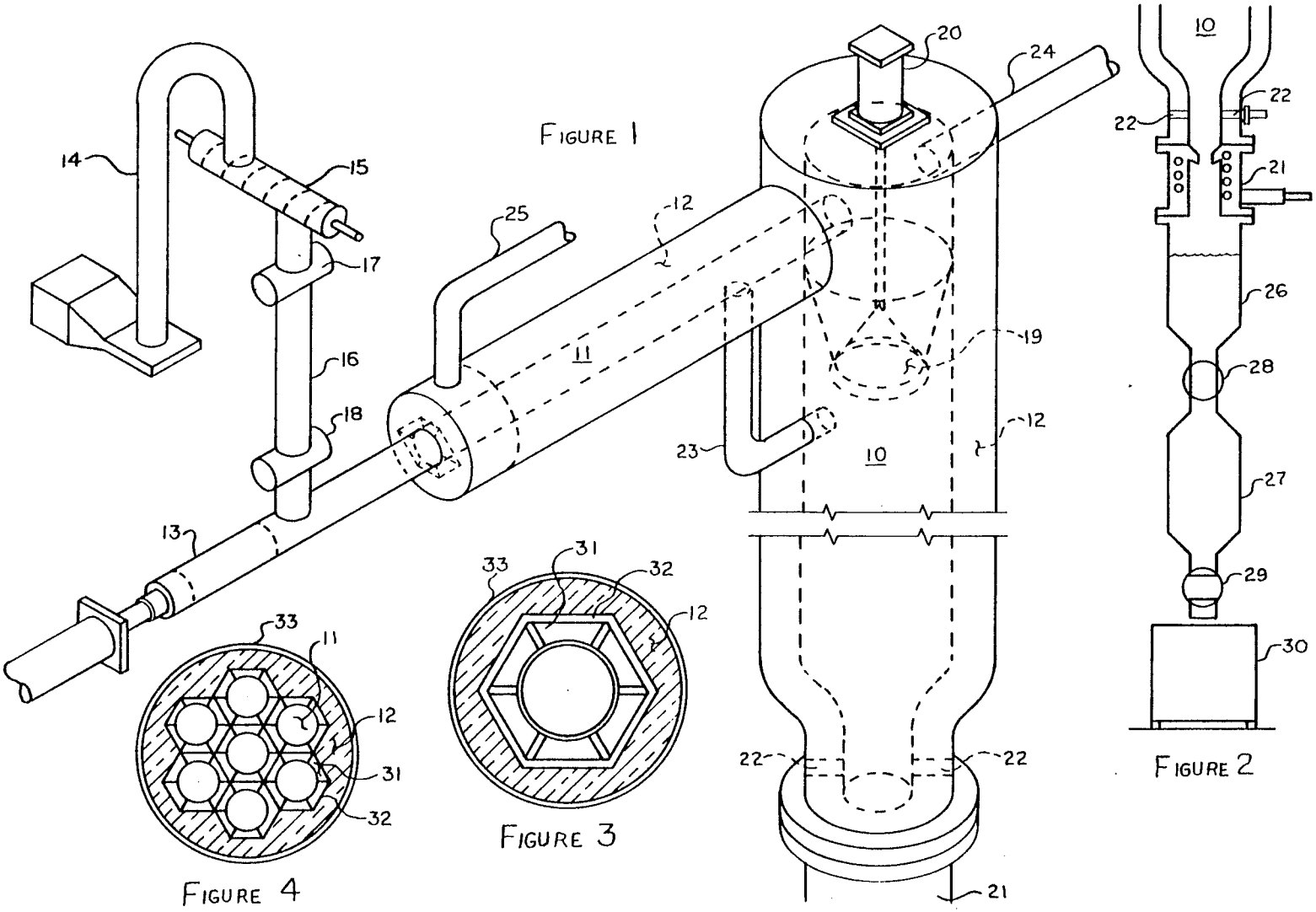
FIG. 1 is a general elevational view showing the means for handling the material containing the ash, the charging means for the material, the means for the pyrolysis of the material and the gasifying means with only an outline of the nozzle means which contains the slag orifice or the directing of the molten slag from the gasifying means.
FIG. 2 is a detailed elevational view showing the botton of the gasifying means, the orifice means, the hot radiant means, the heating means, the slag quenching (cooling) means and a lockhopper means.
FIG. 3 is a configuration (shown in section) of a single means for the pyrolyzation of the material containing the ash.
FIG. 4 is a configuration (shown in section) or a group in bundle form of means for the pyrolyzation of the material containing the ash.

In FIG. 1, reference numeral 10 is the gasifier and numeral 11 is the pyrolysis chamber which preferably is disposed essentially horizontal and is connected at one end to gasifier 10. Both gasifier 10 and pyrolysis chamber 11 are preferably made in the form of pressure vessels lined with refractory material 12. The other end of pyrolysis chamber 11 is connected to a charging mechanism represented by numeral 13 which force feeds the solid material containing the ash.

This material is delivered by any one of conventionally known systems that deliver bulk material as for example elevating conveyor 14, screw conveyor 15, and locking chamber 16 which possesses upper isolation valve 17 and lower isolation valve 18.

Gasifier 10 at the top end thereof, may in some cases be equipped with a char isolation bell represented by numeral 19 which is adapted to be raised and lowered by means of mechanism 20; in other cases, bell 19 may be obviated. At the bottom end of gasifier 10, a slagging nozzle represented by numeral 21 is disposed. Slightly above nozzle 21, a plurality of tuyeres represented by numeral 22 are provided for the injection of oxidant, such as air or pure oxygen, into gasifier 10. The gases from gasifier 10 and pyrolysis chamber 11 may be carried by conventional piping, as for example pipes 23, 24 and 25.

Referring to FIG. 2, beneath slagging nozzle 21, a means to cool the slag is provided which may take the form of a quench chamber shown by numeral 26; quench chamber 26 is adapted to contain water for the cooling of slag in order to solidify it. And, beneath quench chamber 26, a lockhopper is provided represented by numeral 27. Lockhopper 27 possesses isolation valves 28 and 29; valve 28 being positioned at the top of lockhopper 27 and valve 29 being positioned at the bottom of lockhopper 27. Valves 28 and 29 serve to discharge the slag from the system without the depressurization of gasifier 10. The discharged slag which is in solid and vitrified form is collected in bin 30.

Referring to FIG. 3, pyrolysis chamber 11, may be structured in such a way as to have gas passages represented by numeral 31 which are contained in a jacket shown by numeral 32. Refractory 12 is contained between jacket 32 and a surrounding pressure boundary which is represented by numeral 33. Instead of housing only one pyrolysis chamber 11 in pressure boundary 33, a plurality of pyrolysis chambers may be bundled together in such a way as to be contained in a single pressure boundary 33; FIG. 4, shows one configuration for grouping a bundle of pyrolysis chambers, such as pyrolysis chamber 11, together. Other configurations may also be used.

Figures 5, 6, 7:
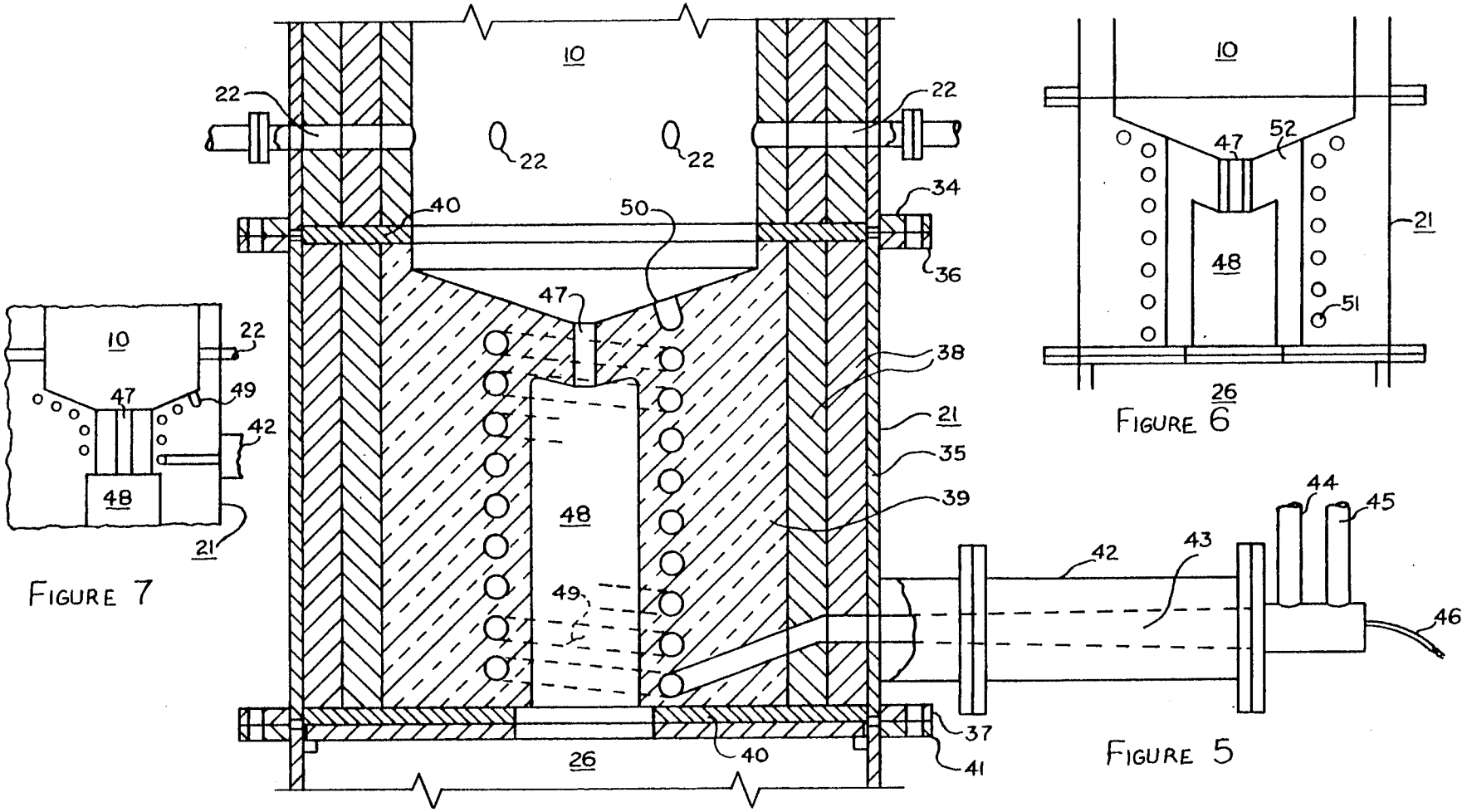
FIG. 5 is a detailed elevation (shown in section) of the orifice means to direct the molten slag out of the gasifying means.
FIG. 6 is an alternate construction of the nozzle for directing molten slag from the gasifying means.
FIG. 7 is a representation of a nozzle having an orifice and sloping surface leading to the orifice, the orifice as well as the sloping surface being indirectly heated.

Referring to FIG. 5 for a more detailed description of the construction of the bottom of gasifier 10, preferably this bottom possesses a flange shown by numeral 34 to which slagging nozzle 21 is connected. Slag nozzle 21 comprises the following:

(a) Pressure shell 35 which serves as a pressure boundary and is equipped with flanges 36 and 37 for mounting to the bottom of gasifier 10 with flange 36 and to the top of quenching hopper 26 with flange 37;

(b) Insulation 38 which is disposed to shell 35, serves for the prevention of heat loss from shell 35;

(c) Refractory 39 which is disposed within insulation 38 is used for the containment of thermal energy input into slag nozzle 21;

(d) Fiberboard insulation 40 is disposed between the flange 34 of gasifier 10 and flange 36 of slag nozzle 21, and between flange 37 of slag nozzle 21 and flange 41 of quench hopper 26; and (e) Pressure burner 42 which supplies the thermal energy to slag nozzle 21. Burner 42 is equipped with combustion chamber 43, air inlet 44, gas inlet 45 and igniter 46.

Refractory 39, which contains the orifice through which the slag flows, is represented by numeral 47. Refractory 39 is a material resistant to slag attack, as for example "Greencast 94" or "Jade Pak 88" as manufactured by the A. P. Green Co. of Missouri, or a dense graphite which is also resistant to slag attack. Concentric to orifice 47 and below it, radiant zone 48 is provided in such a way as to have orifice 47 recessed into and above radiant zone 48. Both radiant zone 48 and orifice 47 are circumscribed by a spiral conduit, shown by numeral 49 which conduit serves to conduct hot gases from combustion chamber 43 of burner 42 and to discharge the products of combustion into the bottom of gasifier 10 through discharge aperture 50. Orifice 47 may be made as an integral part of refractory 39 as an independent replaceable insert.

Spiral conduit 49 may take the shape of an electric induction heating coil shown in FIG. 6 and denoted by numeral 51 which coil heats susceptor 52. Susceptor 52 which could be made of graphite and may have orifice 47 as an integral part of susceptor 52 or provided with a separate insert. Radiant zone 48 is also provided with the same structure as that shown in FIG. 5, in order to recess orifice 47 above radiant zone 48, and away from quenching chamber 26. The exit end of orifice 47 may be designed with dripping feature by having the bottom of orifice 47 protrude downwardly a short distance into zone 48.

Referring to FIG. 7, spiral 49, which is the heating flue, heats orifice 47 as well as the bottom of gasifier 10 indirectly. The flue gases from burner 42 are first spun around orifice 47, then they are directed under the bottom of gasifier 10 and thence discharged into gasifier 10, this configuration being an alternate way of heating nozzle 21.

OPERATION

Referring to the drawings, the material containing the ash is raised by conveying means 14 and fed by means of feeder 15 into lockhopper 16 by having valve 18 closed and valve 17 open. In charging the material, valve 17 is closed and valve 18 opened, and piston 13 being used to force feed the material into pyrolysis chamber 11 where the material is pyrolyzed to form a residue (char) which is fed into gasifier 10. Heat for pyrolysis may be applied by any one of known ways including the useage of gases generated in gasifier 10 directed in space 31 between jacket 32 and the outside surface of chamber 11.

The residue or char discharged into gasifier 10 is gasified preferably with air injected at the bottom of gasifier 10 through tuyeres 22 to gasify the carbon in the residue (char) by partially combusting part of the carbon in the ash. The temperature at the bottom of gasifier 10 becomes very elevated, 2500°+ to cause the ash contained in the material to melt and become a vitrious slag. This slag flows through orifice 47 but it tends to cool quite rapidly and solidify while forming icicles (stalactites) at the bottom of orifice 47, slowing down the flow. These icicles eventually close orifice 47 and the flow of the slag is interrupted.

To prevent the formation of icicles at the exit end of orifice 47, the folloiwng conditions are provided;

1. Orifice 47 is recessed to remove it away from quenching hopper 26 which is maintained cool.
2. Radiant zone 48 is provided below orifice 47 and concentric to it in order to provide a hot buffer between the exit of orifice 47 and quenching hopper 26.
3. Heat is applied to both orifice 47 and radiant zone 48 in order to make up for heat loss to maintain the slag in molten form until it leaves the bottom of orifice 47; and,
4. The diameter between the walls of radiant zone 48 is made somewhat larger than the diameter of orifice 47 in order to prevent flowing slag from touching or sliding against the walls of radiant zone 48.

All in all, it is submitted that the instant invention provides a new and improved apparatus for gasifying a fuel or a mixture of fuels containing ash or residue adapted to produce a molten slag from said ash, which when such slag is solidified, this slag becomes vitrified (glassy) and essentially inert. The intention herein is to use coal, lignite, trash, ash, tires, municipal waste, etc. singularly or in combustion.

What is claimed is:

1. A gasifier for the gasification of a material into a gas and a molten slag comprising:
   - a chamber for the containment of the material;
   - means for converting the material in said chamber into a gas and a molten slag;
   - quenching means for cooling and solidifying the molten slag;
   - a nozzle interposed between said chamber and said quenching means, said nozzle including an orifice having an inlet end for receiving the molten slag from said chamber and an outlet end for discharging the molten slag into said quenching means;
   - a recessed zone defined in said nozzle between said outlet end of said orifice and said quenching means; and
   - means for providing heat in said recessed zone to prevent the solidification of the slag at the outlet end of said orifice.

2. The invention defined in claim 1 wherein the material is a fuel material containing ash and said means for converting including means for injecting an oxidant into said chamber for converting the ash-containing material into the gas and the molten slag.

3. The invention defined in claim 2 wherein said means for injecting includes tuyere means for injecting air or oxygen into said chamber.

4. The invention defined in claim 1 wherein said chamber is a pressurized chamber.

5. The invention defined in claim 1 wherein said orifice extends downwardly into said recessed zone and an upper portion of said recessed zone tapers upwardly from said outlet end of said orifice.

6. The invention defined in claim 1 wherein said means for providing heat includes a burner for generating hot gases and a conduit disposed in said nozzle for passing said hot gases about said recessed zone to provide heat therein.

7. The invention defined in claim 6 wherein said conduit extends helically about said orifice and said recessed zone.

8. The invention defined in claim 1 wherein said means for providing heat includes an electric induction heating coil disposed in said nozzle.

9. The invention defined in claim 8 wherein said heating coil extends helically about said orifice and said recessed zone.

10. An apparatus for pyrolyzing a fuel material to produce a volatile matter and a char material and for gasifying the char material to produce a gas and a molten slag comprising;

a pyrolysis chamber;

means for introducing the fuel material into said pyrolysis chamber under pressure;

means for pyrolyzing the fuel material in said pyrolysis chamber to produce a volatile matter and a char material;

a gasifying chamber;

means for moving said char material from said pyrolysis chamber into said gasifying chamber;

means for converting the char material in said gasifying chamber into a gas and a molten slag;

quenching means for cooling and solidifying the molten slag;

a nozzle interposed between said gasifying chamber and said quenching means, said nozzle including an orifice having an inlet end for receiving the molten slag from said gasifying chamber and an outlet end for dicharging the molten slag into said quenching means;

a recessed zone defined in said nozzle between said outlet end of said orifice and said quenching means; and means for providing heat in said recessed zone to prevent the solidification of the slag at the outlet end of said orifice.

11. The invention defined in claim 10 wherein the material is a fuel material containing ash and said means for converting including means for injecting an oxidant into said gasifying chamber for converting the ash-containing material into the gas and the molten slag.

12. The invention defined in claim 11 wherein said means for injecting includes tuyere means for injecting air or oxygen into said gasifying chamber.

13. The invention defined in claim 10 wherein said gasifying chamber is a pressurized chamber.

14. The invention defined in claim 10 wherein said orifice extends downwardly into said recessed zone and an upper portion of said recessed zone tapers upwardly from said outlet end of said orifice.

15. The invention defined in claim 10 wherein said means for providing heat includes a burner for generating hot gases and a conduit disposed in said nozzle for passing said hot gases about said recessed zone to provide heat therein.

16. The invention defined in claim 15 wherein said conduit extends helically about said orifice and said recessed zone.

17. The invention defined in claim 10 wherein said means for providing heat includes an electric induction heating coil disposed in said nozzle.

18. The invention defined in claim 17 wherein said heating coil extends helically about said orifice and said recessed zone.

* * * * *